United States Patent [19]

Gilmore

[11] Patent Number: 4,649,733

[45] Date of Patent: Mar. 17, 1987

[54] PUNCH WITH COMPRESSION SLEEVE

[75] Inventor: Robert L. Gilmore, Granbury, Tex.

[73] Assignee: General Dynamics Corporation, Fort Worth, Tex.

[21] Appl. No.: 767,687

[22] Filed: Aug. 20, 1985

Related U.S. Application Data

[63] Continuation of Ser. No. 542,000, Oct. 14, 1983, abandoned.

[51] Int. Cl.[4] ..... B21J 13/02

[52] U.S. Cl. ..... 72/479; 72/465; 29/243.53; 29/275

[58] Field of Search ..... 72/479, 467, 480, 465; 29/243.53, 243.54, 243.55, 275; 30/283, 130, 368; 83/140

[56] References Cited

U.S. PATENT DOCUMENTS

| | | | |
|---|---|---|---|
| 940,467 | 11/1904 | Lau | 72/479 |
| 1,289,526 | 12/1918 | Nye . | |
| 2,321,225 | 6/1943 | McIntire | 72/479 |
| 2,328,391 | 8/1943 | Nelson | 72/479 |
| 2,330,575 | 9/1943 | Graulding | 1/50 |
| 2,338,592 | 1/1944 | Lorenzen | 30/368 |
| 2,353,559 | 7/1944 | Hajek, Jr. | 72/479 |
| 2,354,914 | 8/1944 | Goldstein | 72/479 |
| 2,430,532 | 11/1947 | Rayburn | 1/47 |
| 2,630,030 | 3/1953 | Gann | 72/465 |
| 3,426,573 | 2/1969 | Wilson, Jr. | 72/479 |
| 3,964,660 | 6/1976 | Hensley | 227/15 |
| 4,218,911 | 8/1980 | Johnston | 72/479 |

*Primary Examiner*—R. L. Spruill
*Assistant Examiner*—David B. Jones
*Attorney, Agent, or Firm*—James E. Bradley; Robert A. Felsman; Charles E. Schurman

[57] ABSTRACT

A punch for setting a rivet has features to prevent swelling of the rivet between the two members being secured together. The punch has an elongated, solid blow transmitting member with a blow receiving surface and a shank. A sleeve is slidingly carried by the shank and movable from a position protruding past the lower end of the shank. The sleeve has a sidewall with at least one elongated slot extending therethrough. A pin is secured in the shank and extends laterally outward from the shank into the slot to retain the sleeve. A spring urges the sleeve downwardly.

3 Claims, 2 Drawing Figures

FIG. 1
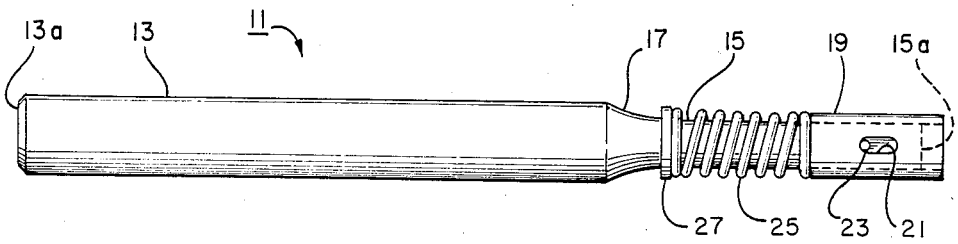
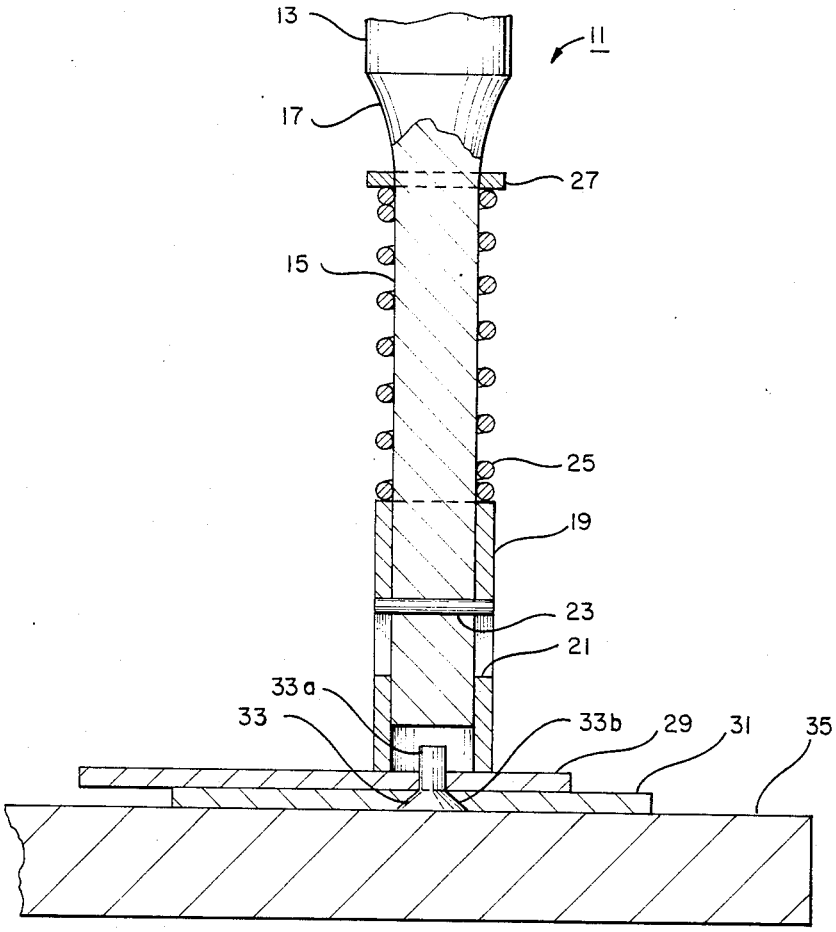
FIG. 2

PUNCH WITH COMPRESSION SLEEVE

The Government has rights in this invention pursuant to Contract No. F-33657-75-C-0310 awarded by the Department of the Air Force.

This application is a continuation of application Ser. No. 542,000, filed Oct. 14, 1983, now abandoned.

BACKGROUND OF THE INVENTION

1. Field of the Invention

This invention relates in general to a hand punch for setting rivets, and in particular to a punch having a compression sleeve for assisting in setting the rivet.

2. Description of the Prior Art

There are several methods to set a rivet between two members. In one method, holes are provided in the member. A rivet is inserted through the holes, with its head resting on an anvil surface. The shank of the rivet faces upwardly. The workman then places a conventional punch on the shank of the rivet and strikes the punch with a hammer.

A disadvantage of this method is that the rivet may swell between the members. Also, deforming the shank into a uniform head requires considerable skill by the workman.

There are other means to set rivets. For example, a rivet press is available which has a plunger for forming the shank into a head. Presses are available that have a spring biased guide sleeve surrounding the plunger for contacting the member being riveted. However, generally, a rivet press has a tendency to cut the head being formed if it is not properly centered. Also, the two members being riveted together must be clamped to prevent swelling of the rivets between the materials, causing them to spread apart or separate. Access to the rivets by the rivet press is limited.

Rivet guns are available, but they must be used with a bucking bar, which is sometimes difficult to use without utilizing two people. Also, rivet guns have a tendency to damage the members being riveted together. Again, the materials must be clamped together to prevent swelling of the rivets between the materials. Uniformity of the head being formed on the rivet is also hard to maintain with a rivet gun.

SUMMARY OF THE INVENTION

In this invention, a device is disclosed for hand setting of rivets. This device is a punch having an elongated, solid blow transmitting member with an upper end for receiving a blow from a hammer. The blow transmitting member has a shank on its lower end, terminating in a flat end for forming the shank of the rivet into a formed head. A sleeve is slidingly carried on the shank. This sleeve will move from a position protruding below the shank to a position flush with the shank. A coil spring encircles the shank and is used to bias the sleeve downwardly. The sleeve has a sidewall with a slot extending through it that receives a pin. The pin retains the sleeve on the shank. The biased sleeve encircles the rivet shank and holds the two members together as the rivet is being formed.

BRIEF DESCRIPTION OF THE DRAWINGS

FIG. 1 is a side view of a punch constructed in accordance with this invention.

FIG. 2 is an enlarged, partial sectional view of the punch of FIG. 1, shown in readiness for setting a rivet.

DESCRIPTION OF THE PREFERRED EMBODIMENT

Referring to FIG. 1, punch 11 includes a solid, steel member with a grip 13 on one end. Grip 13 may be cylindrical or polygonal and is formed for gripping by the workman. Grip 13 has a flat upper end 13*a* that is the blow receiving surface. Grip 13 is integral with an extends downwardly into a shank 15. Shank 15 is of smaller diameter than drip 13 and is normally cylindrical. Shank 15 has a lower end 15*a* that transmits the blow to the workpiece. A frusto-conical surface 17 is defined by the intersection of the shank 15 and the grip 13.

A cylindrical tubular sleeve 19 is slidingly carried on the shank 15. Sleeve 19 has only a slightly greater inner diameter than the outer diameter of shank 15. Sleeve 19 has a length that is about half the length of the shank. Two slots 21 are formed in the sidewall of sleeve 19. Slots 21 are formed 180 degrees apart from each other. Each slot 21 is elongated, as shown in FIG. 1, with a greater length than its width.

A pin 23 is secured within a hole formed in the shank 15. Pin 23 has two ends, each of which protrude outwardly past the outer surface of the shank 15. Each end of the pin 23 engages one of the slots 21. Pin 23 limits the downward and upward travel of the sleeve 19 with respect to the shank 15.

A coil spring 25 encircles shank 15 for serving as spring means for urging the sleeve 19 downwardly. Coil spring 25 has a lower end that bears against the upper edge or end of sleeve 19. The upper end of spring 25 bears against a washer or stop member 27. The stop member 27 is an annular member having an inner diameter that is slightly greater than the diameter of the shank 15, but less than the diameter of the grip 13. This causes the member 27 to lodge on the frusto-conical surface 17. Spring 25 has a length that is selected so that it will be in compression when the sleeve 19 is in its lowermost position, as shown in FIG. 2. Preferably, spring 25 requires about 20 pounds force to compress it sufficient so that its lower end is flush or slightly above the lower end 15*a* of shank 15.

Punch 11 is constructed by taking a conventional punch and drilling a hole through it for receiving pin 23. Stop member 27 is inserted over the shank 15, then coil spring 25. Sleeve 29 is then inserted onto the shank 15, and pin 23 is driven tightly through the hole in the shank 15. Pin 23 is located perpendicular to the axis of the shank, and its ends will extend laterally outward from the shank 15 into the slots 21.

To use the punch 11, two members or plates 29 and 31 are placed in contact with each other. Each plate 29 and 31 has a hole for receiving a rivet 33. Rivet 33 is a conventional, deformable rivet, having a cylindrical shank 33*a* that protrudes upwardly above the upper plate 29. Rivet 33 has a frusto-conical head received within a counterbored holes in lower plate 31. Head 33 is flush with the lower surface of plate 31. The plates 29 and 31 will be placed on an anvil surface 35, with the head 33*b* of the rivet flush against the plate 35. The plates 29 and 31 need not be clamped together.

The workman then places the punch onto the upper plate 29, with the sleeve 19 concentric around the shank 33*a*. It is not necessary that the workman apply downward pressure on the punch 11 prior to delivering the blow. The lower end 15*a* of the punch shank 15 will normally be located above the rivet shank 33*a* at the instant that the the manner strikes the punch. When the workman strikes the upper end 13*a* of punch 11, the punch shank 15 will move downwardly, compressing the spring 25. This will cause the sleeve 19 to exert pressure on the plates 29 and 31 as the lower end 15*a* of the shank strikes the rivet shank 33*a*. This prevents swelling of the rivet 33 between the plates 29 and 31.

The invention has significant advantages. It applies a constant pressure to both the material and the rivet while riveting. This provides a flusher rivet, with more uniform swelling than prior art devices. The opportunity for the rivet to swell between the members being riveted is reduced. The punch is fast, easy to operate, simple and convenient.

While the invention has been shown in only one of its forms, it should be apparent to those skilled in the art that it is not so limited but is susceptible to various improvements without departing from the scope of the invention.

I claim:

1. A punch for setting a rivet between an upper and a lower workpiece, comprising in combination:

an elongated, solid blow transmitting member having a gripping portion with an upper end for receiving a blow, and a shank extending downwardly from the gripping portion for contact with a rivet, the shank being of smaller diameter than the gripping portion, defining between them a downwardly facing tapered surface;

a sleeve slidingly carried by the shank, the sleeve being movable upwardly relative to the shank from a position in which its lower end protrudes below the lower end of the shank, the sleeve having a sidewall with at least one elongated slot extending therethrough;

the sleeve and shank having lower ends with parallel surfaces generally perpendicular to the elongated member and the sleeve, having an interior surface generally parallel with, and avoiding impact, with the shank to minimize fatigue failure:

an unthreaded pin extending laterally from the shank into the slot to retain the sleeve and allow reciprocation of the sleeve relative to the shank;

a stop member carried by the transmitting member for movement therewith at the tapered surface;

a coil spring encircling the shank, having its upper end bearing against the stop member and its lower end bearing against an upper end of the sleeve to urge the sleeve downwardly relative to the shank;

the length of the slot and position of the pin preventing the transmission of blow energy into the sleeve;

the shank being movable downwardly relative to the sleeve as a blow strikes the upper end of the transmitting member to deform the protruding portion of the rivet, with some of the energy of the blow being transmitted through the spring to the sleeve and to the upper workpiece, to reduce the tendency for the workpieces to spread apart as the rivet deforms.

2. The punch according to claim 1 wherein the stop member comprises an annular member having an inner diameter less than the diameter of the gripping portion.

3. A punch for setting a rivet between an upper and a lower workpiece, comprising in combination:

an elongated, solid blow transmitting member having a gripping portion with a blow receiving surface on its upper end and a shank of smaller diameter than the gripping portion extending below the gripping portion for contact with a rivet, defining between them a downwardly facing tapered surface;

a sleeve slidingly carried by the shank for contact with the upper workpiece surrounding a protruding portion of the rivet, the sleeve being movable upwardly relative to the shank from a position in which its lower end protrudes below the lower end of the shank;

the sleeve and shank having lower ends with parallel surfaces generally perpendicular to the elongated member, and the sleeve having an interior surface generally parallel with, and avoiding impact with, the shank to minimize fatigue failure;

the sleeve having a sidewall with two elongated slots on opposite sides from each other;

an unthreaded pin secured in a hole formed in the shank and having two ends protruding from the shank, each end extending into one of the slots to retain the sleeve and allow reciprocation of the sleeve relation to the shank;

a stop member carried by the transmitting member for movement therewith at the tapered surface;

a coil spring encircling the shank, having its upper end bearing against the stop member and its lower end bearing against an upper end of the sleeve, urging the sleeve downwardly relative to the shank;

the length of the slot and position of the pin preventing the transmission of blow energy into the sleeve;

the shank being movable downwardly relative to the sleeve as a blow strikes the transmitting member to deform the protruding portion of the rivet, with some of the energy of the blow being transmitted through the spring to the sleeve and to the upper workpiece, to reduce the tendency for the workpieces to spread apart as the rivet deforms.

* * * * *